United States Patent [19]

Guest et al.

[11] 3,938,870

[45] Feb. 17, 1976

[54] DOCUMENT FILING APPARATUS

[76] Inventors: Jack Bernard Guest; Kathleen Ethel Joyce Guest, both of 119 Albury Drive, Pinner, Middlesex, England

[22] Filed: July 26, 1974

[21] Appl. No.: 492,060

Related U.S. Application Data

[63] Continuation-in-part of Ser. No. 365,635, May 31, 1973, abandoned.

[52] U.S. Cl. ..... 312/184; 24/243 G

[51] Int. Cl.[2] ..... A47B 63/00; A44B 21/00

[58] Field of Search ..... 312/183, 185, 184; 211/162; 24/243 G, 243 AB, 81 BF

[56] References Cited

UNITED STATES PATENTS

| | | | |
|---|---|---|---|
| 377,526 | 2/1888 | Levy | 24/243 G UX |
| 1,760,592 | 5/1930 | Gift | 24/243 G UX |
| 2,110,037 | 3/1938 | De Rosa | 24/243 G UX |
| 3,614,185 | 10/1971 | Splan | 312/184 |
| 3,748,008 | 7/1973 | Pryor | 312/184 |

FOREIGN PATENTS OR APPLICATIONS

| | | | |
|---|---|---|---|
| 962,318 | 12/1949 | France | 312/184 |
| 89,307 | 5/1967 | France | 312/184 |
| 553,944 | 1/1957 | Italy | 312/184 |

*Primary Examiner*—Donald A. Griffin
*Attorney, Agent, or Firm*—Malcolm W. Fraser, Esq.

[57] ABSTRACT

Document filing apparatus comprising two rails adapted for mounting on opposite side edges of a drawer or the like container for converting the drawer to contain documents or files in a suspended filing system and a plurality of tabs which are attachable to the documents or files and which can be slidably mounted on the rails. Each rail comprises a channel shaped portion having two side walls joined by a web, which is adapted to embrace the edge of the drawer to locate the rail on the drawer edge, and a flange projecting outwardly from one of the side walls of the rail to slidably carry an end of each tab. The flange has a horizontal guideway surface for the tab and a rib spaced from the side wall of the rail which locates in a recess formed in the tab to locate the tab on the rail and resist accidental dislodgement of the tab from the rail. Adjustment means are provided on the channel shaped portion of the rail allowing fine adjustment of the position of the rail in relation to the side of the drawer and locking of the rail in position relative thereto.

3 Claims, 5 Drawing Figures

DOCUMENT FILING APPARATUS

CROSS-REFERENCE TO RELATED APPLICATION

This application constitutes a continuation-in-part of application, Ser. No. 365,635, filed May 31, 1973 now abandoned, and entitled DOCUMENT FILING APPARATUS.

BACKGROUND TO THE INVENTION

The present invention relates to document filing apparatus of the type comprising two spaced rails and a tab adapted for attachment to a document or file, which is slidably mounted on the rails.

In our co-pending U.S. application Ser. No. 139,410 there is described a document filing device comprising a tab for attachment to a leaf of a document or document folder and supporting means for the tab on which the tab can be slidably mounted. The present invention is concerned with the supporting means for the tab and more particularly is concerned to provide supporting means in the form of a rail which can be readily mounted on a side wall of a cabinet drawer or the like so as to convert the drawer to one which can hold files in a suspended filing system and the position of which relative to the side of the drawer can be finely adjusted and locked.

It has already been suggested in U.S. Pat. No. 3,614,185 to provide a rail which can fit over the edge of a drawer and which will support file rods or tabs. This known rail construction has comprised a portion which is sprung onto the edge of the side of the drawer and this has the disadvantage that it will only fit a relatively narrow range of drawer panel thicknesses and if the drawer panel thickness is too great it is liable to work upwardly and spring off the panel edge. The risk of dislodgement in this way is increased if files snag the rail as they are removed from the drawer.

A further disadvantage of this known construction is that there is no facility for adjusting the position of that part of the rail which supports the files in relation to the side of the drawer. The spacing of those parts of the two rails which carry the files is therefor determined solely by the width of the drawer and if this varies the file supporting tab or rod may not fit on the rails or may fit imperfectly so that the tab or rod will not slide smoothly along the rails.

We have also found that substantial economies can be achieved in manufacture if the rail is so designed that it can be extruded and subsequently cut to the required length. This results in a saving in manufacturing costs and a greater flexibility in use since standard lengths of rail can be cut to fit any length of drawer or cabinet.

It is an object of the present invention to provide a rail which can be mounted on the side wall of a drawer so as to support files within the drawer which substantially reduces or obviates the above described problems and disadvantages associated with known rail constructions provided for this purpose.

STATEMENT OF THE INVENTION

According to the present invention there is provided a rail for attachment on a horizontal edge of a vertical panel such as the side wall of a cabinet drawer so as to receive an end of a tab having a recess extending upwardly from a horizontal edge surface thereof and spaced from a vertical edge surface thereof, the rail comprising a channel shaped portion having two side walls joined by a web adapted to embrace the said panel edge whereby the rail is readily mountable on the panel edge, a flange projecting outwardly from one of the said side walls at right angles thereto, an upwardly projecting rib extending lengthwise of the flange which is spaced from the said one side wall, an upwardly facing substantially flat surface on the flange located between the rib and the adjacent side wall of the rail and forming a guideway for the said horizontal edge surface of the tab when the recess in the tab is located over the said rib and adjustment means on the channel shaped portion of the rail enabling the spacing of the rib from the panel to be adjusted and thereafter clamped in position.

DESCRIPTION OF THE PREFERRED EMBODIMENT

Figure 1:
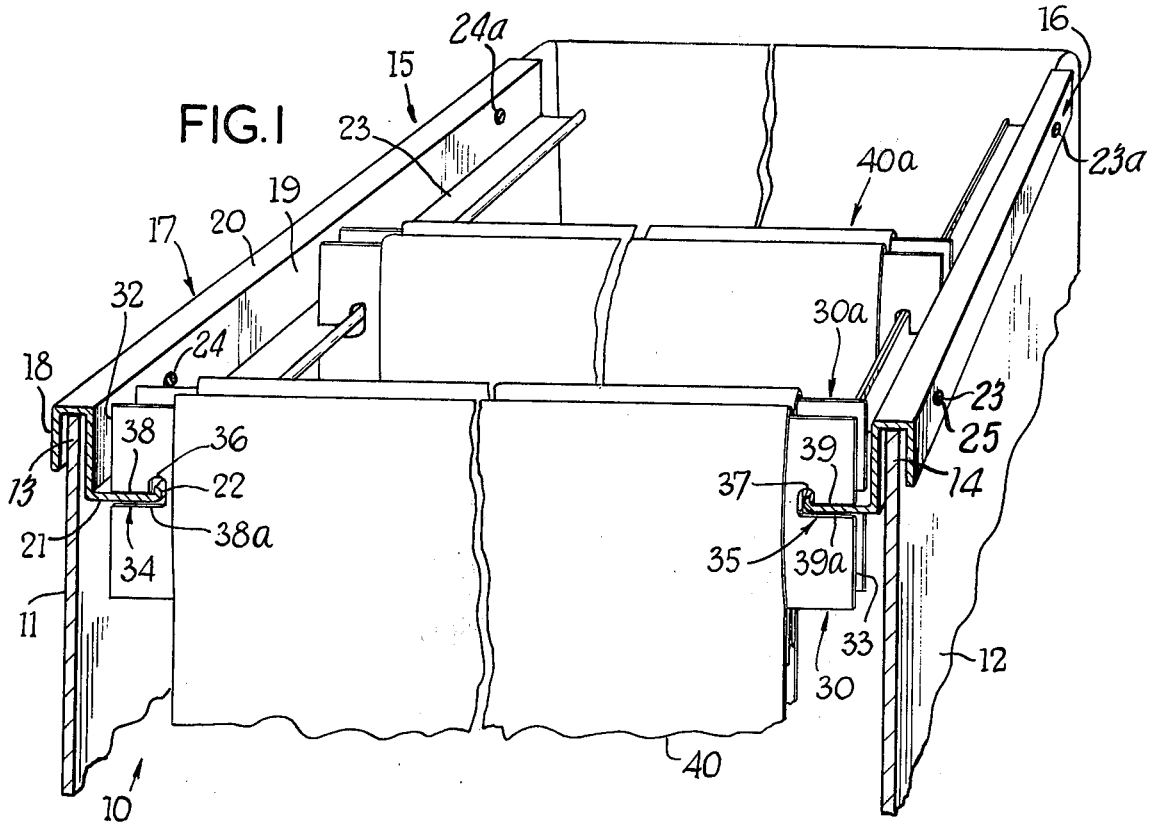
FIG. 1 is a perspective view, parly in section of a desk drawer equipped with the rails and tabs of the present invention.

In the drawing, a desk drawer is indicated generally at 10, having spaced parallel side panels 11 and 12. The drawer 10 is formed from metal and has upper edge portions 13 and 14. Mounted on the upper edges 13 and 14 of the side panels 11 and 12 are two similar rails 15 and 16 only one of which will be described in detail.

The rail 15, which is formed from an extruded metal or metal alloy such as aluminium, comprises a channel-shaped portion 17 having side walls 18 and 19 joined by a flat web 20, a flange 21, and a raised rib 22 on the outer edge of the flange 21.

The internal width of the channel shaped portion 17 is such that it is a loose fit over the edge 13 of the panel 11, with the side walls 18 and 19 embracing the edge of the panel to mount the rail thereon. In order to provide for fine adjustment of the position of the rail relative to the side panel 11 for a purpose to be described below, each side wall 18 and 19 of the rail is provided with two tapped holes 23, **23*a* and 24, 24*a* respectively. The holes in each side wall are spaced apart and similar grub screws 25 are threadedly engaged in the holes 23, 23*a*, 24 and 24*a*. In order to clamp the rail in position on the edge 13 of the panel 11, the grub screws 25 in the side walls 18 and 19 are tightened against the opposite sides of the panel 11. It will be appreciated that, in addition to clamping the rail 15 on the panel 11, the grub screws 25 in each side wall 18 and 19 can be used to adjust the position of the rail in relation to the panel 11. For instance, the rail can be located and clamped with the outer side wall 18 touching the outer surface of the panel 11 or with the inner side wall 19 touching the inner surface of the panel 11** or at any intermediate position therebetween.

The side wall 19 is longer than the side wall 18 and the flange 21 projects outwardly from the end of the side wall 19 substantially at right angles thereto. The upper surface of the flange 21 is substantially flat and forms a guideway 26. The raised rib 22 is located along the edge of the flange remote from the side wall 19 and extends lengthwise of the rail. An internal face 27 of the rib, which faces the side wall 19 lies in a plane perpendicular to the guideway 26 and extends upwardly from the guideway to a height of approximately 0.062 inches. The flange 21 is approximately 0.063 inches thick and the dimension *a* from the bottom surface of the flange 21 to the top of the rib 22 is thus approximately 0.125 inches.

The rails 15 and 16 carry a plurality of tabs 30, 30*a* each of which is attached to a leaf of a document folder 40, 40*a*. The tabs 30, 30*a* are similar and only the tab 30 will be described in detail. The tab 30 is formed, preferably by extrusion in strip form, from a synthetic plastics material such as polypropylene or polyvinyl chloride and is rectangular in shape, having straight parallel side edges 32 and 33. Two aligned slots 34 and 35 extend inwardly from the side edges 32 and 33 and recesses 36 and 37 are formed at the ends of the slots 34 and 35 respectively. The slots 34 and 35 are defined by upper and lower parallel faces 38, 38*a*, and 39, 39*a* respectively and are approximately 0.120 inches wide, that is 0.005 inches less than the dimension *a* referred to above.

The recesses 36 and 37 extend upwardly from the end of each slot to a height substantially greater than the height of the ribs 22 of the rails so that the upper edges 38 and 39 of the tab rest on the guideways 23 when the tab is mounted on the rails. The width of each slot 34 and 35 respectively is slightly less than the combined depth of the rib and flange of each rail, e.g. dimension *a*, so that the flange and rib is a press fit through the slot. The length of the upper edge faces 38 and 39 respectively of the slots is substantially less than the width of the guideways 23 of the rail.

Each of the folders 40, 40*a* comprises two leaves 41 and 42 the free edge portion of each of which is folded over and adhered to the remainder of the leaf to form an open ended slot 43 and 44 respectively. Each folder is attached to a pair of tabs 30, 30*a* by sliding a tab through each of the slots 43 and 44. As can be seen from FIG. 1 the length of the folders is such that the ends of the tabs project from the folder to an extent such that the slots 34 and 35 of each tab are located wholly outside the folder.

In order to mount a folder 40 on the rails 15 and 16, the folder is held by the two tabs 30, 30*a* which extend through the slots in the leaves 41 and 42, the folder is positioned above the drawer 10 at an acute angle to a line at right angles to the rails and lowered into the drawer until the slots 34 and 35 in the two tabs are in line with the flanges of the rails 15 and 16. The folder and the tabs 30, 30*a* are then rotated so that they extend across the rails, thus forcing the flanges 22 and ribs 21 of the rails through the slots 34, 35 in the tabs until the ribs 21 on the ends of the flanges locate in the recesses 36 and 37 at the ends of the slots in the two tabs. The tabs are then free to slide along the rails with the faces 38 and 39 of each tab sliding on the guideways 23 of the two rails.

If the folder 40 is subjected to a rotational force during its normal usage in the drawer 10, this is resisted by the interengagement of the tabs and the ribs on the rails. If the folder is accidentally lifted and rotated at the same time, the height of the rib on each rail, in relation to the width of the slots in the tab is such that the rib will still resist rotation of the tab and thus prevent accidental displacement of the folder from the rails. The rail itself is securely clamped to the side panel of the drawer and thus will not lift away from the drawer under the lifting forces applied to it in normal usage.

Figure 2:
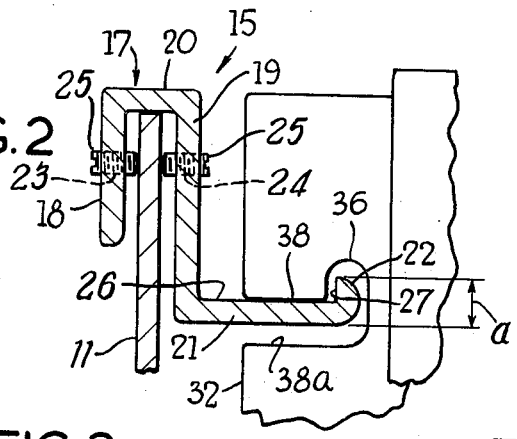
FIGS. 2 and 3 are respectively an end elevation partly in section and side elevation of a rail according to the present invention with a part of a tab and folder mounted thereon shown in FIG. 2, the rail being mounted on a drawer side panel of narrower gauge than that shown in FIG. 1.
Figure 3:
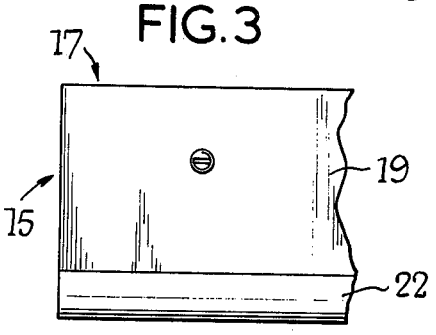
Figure 4:
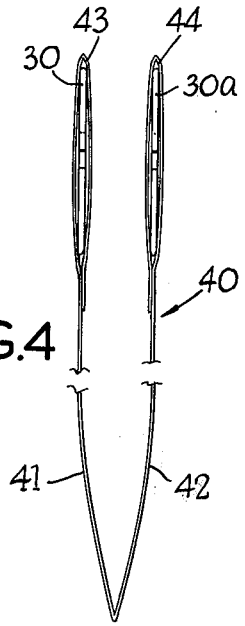
FIG. 4 is an end view of a document folder mounted on two of the tabs forming a part of the present invention.

It will be appreciated that, in order to achieve an easy and smooth sliding action of the tabs along the rails 15 and 16, the spacing of the ribs 22 of the two rails 15 and 16 must correspond exactly to the spacing of the recesses 36 and 37 of each tab. It will be found that the width of a drawer will vary substantially and accordingly it is essential that means are provided on the rail for compensating and adjusting for these variations in drawer width. This is achieved in the present invention, as can be seen most clearly from FIG. 2, by adjusting the grub screws 25 on each side of the rail 15 and rail 16 to achieve the exact spacing of the ribs 22 required to ensure that the recesses 36 and 37 of each tab locate exactly over the ribs with the ribs positioned centrally of the recesses. The grub screws 25 in the rails 15 and 16 thus provide a means for clamping the rails on the drawer sides and for providing the fine adjustment which is necessary to ensure that a standard size tab can be mounted on the rails and slide freely therealong regardless of small variations in the width of the drawer on which the rails are fitted.

Figure 5:
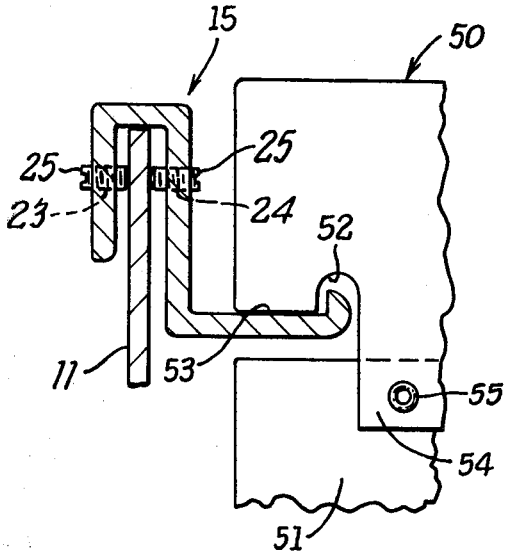
FIG. 5 is a view similar to FIG. 2 of a modification of the tab attached to a single document and mounted on a rail according to the present invention.

It will be understood that the tabs 30, 30*a* can be attached to the folders 40, 40*a* by alternative methods, for instance they can be stapled to the folders and/or adhered to the folders. The tabs can also be attached to single documents or document files as shown in FIG. 5 which illustrates a tab 50 attached to a document 51. As can be seen, the tab 50 differs from the tab 30 in that recesses 52 are formed at the ends of horizontal edge surfaces 53 which constitute shoulders on each side of the tab. The document 51 is wider than portion 54 of the tab which is attached by rivets 55 to the document and thus upper edge 55 of the document performs the same function as the bottom edges 38*a*, 39*a* of the slots in the tab 30. The tab 50 and document 51 are mounted on the rails 15 and 16 in the same manner as the tab 30 and function similarly with the same ease of sliding movement along the rods and security against accidental dislodgement since the spacing between the upper edge of the document and the edge surfaces 53 of the tab is similar to the width of the rods 34 and 35 in the tab 30.

The rib on the flange of each rail is preferably positioned at the outer edge of the flange, but this is not essential and the rib can be positioned between the side wall 19 of the rail and the edge of the flange provided that the rib is spaced from the side wall so as to leave a guideway surface therebetween to receive the face 38 or 39 of the tab.

It will be seen from the above that we have provided apparatus comprising a pair of rails and a plurality of tabs which can be used to convert an empty drawer of a desk or cabinet into an effective suspended filing system for documents in a manner which is cheap to produce, easy to assemble and which can be readily dismantled so as to return the drawer or the like to its original use if required.

It will also be seen from the above that the rail of the present invention is extruded from a metal or metal alloy. This enables the rail to be manufactured in standard lengths at a low cost and subsequently cut to length to suit the length of the drawer or cabinet into which it is to be fitted. This eliminates the necessity to manufacture and stock a range of lengths.

What I claim is:

1. Document filing device for a filing cabinet having a drawer provided with laterally spaced vertical side wall panels comprising in combination, a. a rail for the horizontal edge of each vertical side wall panels, b. each rail comprising a channel shaped portion having a depending inner and an outer side wall joined by a web connecting the upper edges thereof and adapted to embrace said panel edge, whereby the rail is readily mountable on the panel edge, c. a flange projecting inwardly from said inner side wall at right angles thereto, d. an upwardly projecting rib extending lengthwise of said flange and spaced from said inner side wall, e. said rib terminating substantially short of the plane of said web, f. an upwardly facing substantially flat surface on said flange located between said rib and said inner side wall and forming a guideway, g. a tab of a document folder similarly formed at opposite ends with a recess extending upwardly from a horizontal edge surface thereof and spaced laterally from a vertical edge surface thereof, h. said horizontal edge surface engaging said horizontal edge surface of the tab respectively when the recess in the tab is located over said rib, and i. adjustment means on the channel shpaed portion of the rail to engage opposite sides of said panel enabling the spacing of the rib from the panel to be infinitely adjusted and thereafter secured in position.

2. The organization as claimed in claim 1, wherein said adjustment means comprises an adjusting screw in each side wall of said rail for engagement with the vertical drawer panel.

3. Apparatus for converting a container such as a drawer into a document filing space comprising a pair of rails each rail for attachment on a horizontal edge of a vertical panel such as the side wall of a cabinet drawer so as to receive an end of a tab having a recess extending upwardly from a horizontal edge surface thereof and spaced from a vertical edge surface thereof, the rail comprising a channel shaped portion having two side walls joined by a web adapted to embrace the said panel edge, whereby the rail is readily mountable on the panel edge, a flange projecting outwardly from one of the said side walls at right angles thereto, an upwardly projecting rib extending lengthwise of the flange which is spaced from the said one side wall, upwardly facing substantially flat surface on the flange located between the rib and the adjacent side wall of the rail and forming a guideway for the said horizontal edge surface of the tab when the recess in the tab is located over the rib and adjustment means on the channel shaped portion of the rail enabling the spacing of the rib from the panel to be adjusted and thereafter clamped in position, and a plurality of tabs each of which is adapted for attachment to a document folder, each tab being formed with two parallel side edges, a horizontal edge surface adjacent each side edge and a recess extending upwardly into each horizontal edge surface and adapted to receive the said rib of a rail so that the tab is slidably engaged thereon with the horizontal edge surface resting on the said guideway of the rail and slidable therealong, the horizontal edge surfaces of each tab comprise the upper edges of a pair of slots in the tab and wherein the width of each slot is such in relation to the dimensions of the rib on each rail that the rib is a force-fit through the slot for location in the recess.

* * * * *